US011566811B2

(12) United States Patent
Chen et al.

(10) Patent No.: US 11,566,811 B2
(45) Date of Patent: Jan. 31, 2023

(54) DOOR ASSEMBLY FOR AIR CONDITIONER INDOOR UNIT AND AIR CONDITIONER INDOOR UNIT HAVING THE SAME

(71) Applicants: GD MIDEA AIR-CONDITIONING EQUIPMENT CO., LTD., Foshan (CN); MIDEA GROUP CO., LTD., Foshan (CN)

(72) Inventors: Liangrui Chen, Foshan (CN); Daijie Peng, Foshan (CN); Hanjie Hu, Foshan (CN); Zhiqiang Yang, Foshan (CN); Jianxiong Bai, Foshan (CN); Shouliang Song, Foshan (CN); Zeping Li, Foshan (CN); Wuzhong Wang, Foshan (CN)

(73) Assignees: GD MIDEA AIR-CONDITIONING EQUIPMENT CO., LTD., Foshan (CN); MIDEA GROUP CO., LTD, Foshan (CN)

( * ) Notice: Subject to any disclaimer, the term of this patent is extended or adjusted under 35 U.S.C. 154(b) by 677 days.

(21) Appl. No.: 16/499,494

(22) PCT Filed: Mar. 28, 2019

(86) PCT No.: PCT/CN2019/080063
§ 371 (c)(1),
(2) Date: Sep. 30, 2019

(87) PCT Pub. No.: WO2020/172937
PCT Pub. Date: Sep. 3, 2020

(65) Prior Publication Data

US 2021/0325078 A1 Oct. 21, 2021

(30) Foreign Application Priority Data

Feb. 25, 2019 (CN) ..... 201910139129.3
Feb. 25, 2019 (CN) ..... 201920239376.6

(51) Int. Cl.
*F24F 13/12* (2006.01)
*F24F 1/028* (2019.01)
(Continued)

(52) U.S. Cl.
CPC ..... *F24F 13/12* (2013.01); *F24F 1/028* (2019.02); *F24F 13/06* (2013.01); *F24F 1/0011* (2013.01); *F24F 13/10* (2013.01)

(58) Field of Classification Search
CPC ..... F24F 1/028; F24F 13/12
See application file for complete search history.

(56) References Cited

U.S. PATENT DOCUMENTS

2012/0034862 A1* 2/2012 Kim ..... F24F 1/0073 454/254
2017/0016634 A1 1/2017 Lee et al.
2018/0209687 A1 7/2018 Chun et al.

FOREIGN PATENT DOCUMENTS

CN 105783225 A 7/2016
CN 106958866 A 7/2017
(Continued)

OTHER PUBLICATIONS

Intellectual Property Office of Korea (IPKR) The Office Action for KR Application No. 10-2019-7030461 dated Nov. 19, 2020 12 Pages (Translation Included ).
(Continued)

*Primary Examiner* — Joseph F Trpisovsky
(74) *Attorney, Agent, or Firm* — Anova Law Group PLLC

(57) ABSTRACT

A door assembly for an air conditioner indoor unit includes a door mounting plate, a door, a guiding part, and a drive assembly. The door mounting plate includes a receiving groove and a guiding groove. The door is configured to be movable in a direction approaching and away from the door
(Continued)

mounting plate. The guiding part is connected with the door, located at a side of the door facing the door mounting plate, and movably disposed in the guiding groove. The drive assembly is configured to drive the door to move, and is disposed in the receiving groove.

20 Claims, 8 Drawing Sheets

(51) Int. Cl.

| | |
|---|---|
| ***F24F 13/06*** | (2006.01) |
| *F24F 13/10* | (2006.01) |
| *F24F 1/0011* | (2019.01) |

(56) References Cited

FOREIGN PATENT DOCUMENTS

| | | | | |
|---|---|---|---|---|
| CN | 107835917 | A | | 3/2018 |
| CN | 208025666 | U | | 10/2018 |
| KR | 20100050311 | A | | 5/2010 |
| KR | 101271056 | B1 | | 6/2013 |
| KR | 20140019106 | A | * | 2/2014 |
| KR | 20140037985 | A | | 3/2014 |
| KR | 1020150082969 | A | | 7/2015 |
| KR | 101927885 | B1 | | 12/2018 |

OTHER PUBLICATIONS

Japan Patent Office (JPO) Notice of Reasons for Refusal for JP Application No. 2019-556348 dated Jul. 13, 2021 10 Pages (including translation).

Korean Intellectual Property Office (KIPO) Notification of Reason for Refusal for KR Application No. 10-2019-7030461 dated Jul. 19, 2021 13 Pages (including translation).

World Intellectual Property Organization (WIPO) International Search Report for PCT/CN2019/080063 dated Nov. 18, 2019 21 Pages.

World Intellectual Property Organization (WIPO) Written Opinion for PCT/CN2019/080063 dated Nov. 18, 2019 9 Pages.

* cited by examiner

DOOR ASSEMBLY FOR AIR CONDITIONER INDOOR UNIT AND AIR CONDITIONER INDOOR UNIT HAVING THE SAME

CROSS-REFERENCE TO RELATED APPLICATIONS

The present application is a National Stage Entry under 35 U.S.C. § 371 of International Application No. PCT/CN2019/080063, filed Mar. 28, 2019, which claims priority to Chinese Application Nos. 201910139129.3 and 201920239376.6, both filed Feb. 25, 2019, the entire contents of all of which are incorporated herein by reference.

FIELD

The present disclosure relates to the field of air processing equipment, and in particular to a door assembly for an air conditioner indoor unit and the air conditioner indoor unit having the same.

BACKGROUND

In order to prevent the particulate pollutants in the air from entering the air conditioner along the air outlet when the air conditioner stops running, thereby affecting the quality of the air sent by the air conditioner, a door is usually provided to close the air outlet when the air conditioner stops running. However, by adopting the related technology, the door is limited and guided by the driving mechanism during its opening or closing, resulting in poor limiting and the guiding effect.

SUMMARY

The purpose of the present disclosure is to address at least one of the technical problems in the existing technology. To this end, the present disclosure provides a door assembly for the air conditioner indoor unit, where the door assembly of the air conditioner indoor unit is stable and its movement trajectory is relatively easy to control.

The present disclosure also provides an air conditioner indoor unit equipped with the door assembly.

The door assembly according to the first embodiment of the present disclosure includes a door mounting plate, a door, a guiding part, and a drive assembly for driving the door to move. The door mounting plate is provided with a receiving groove, and the door mounting plate is further provided with a guiding groove, so that the door is movable in a direction approaching and away from the door mounting plate, the guiding part is connected to the door and is located on the side of the door facing the door mounting plate, and the guiding part is movably disposed in the guiding groove, and the driving assembly is disposed in the receiving groove.

For the door assembly according to the first embodiment of the present disclosure, the guiding part can slide along the guiding groove when the drive assembly drives the door to move forward or backward, and the door can also slide along with the guiding part, so that the door has a better stability when moving. In addition, while the guiding stricture is sliding along the guiding groove, the guiding groove can also limit the guiding part, thereby controlling the movement track of the door, making the movement trajectory of the door more precise.

In addition, the door assembly of the air conditioner indoor unit according to the present disclosure may also have the following additional technical features:

In some embodiments of the present disclosure, the door mounting plate includes: a frame and a mounting part, the mounting part is disposed at the frame and located at the lateral middle position of the frame, both the receiving groove and the guiding groove are formed at the mounting part.

In some embodiments of the present disclosure, the receiving groove is formed at a side of the mounting part far from the door, the drive assembly is disposed at the receiving groove, and at least one part of the drive assembly passes through the bottom wall of the receiving groove and then is connected to the door.

In some embodiments of the present disclosure, the guiding groove is formed at a side of the mounting part facing the door.

In some embodiments of the present disclosure, the guiding groove has a ring shape and is disposed around the outer side of the receiving groove.

Optionally, the cross-sectional area of the guiding groove gradually decreases in a direction from the door to the door mounting plate.

Optionally, the guiding groove is formed by the first wall and the second wall of the ring disposed around the receiving groove, the second wall is disposed around the peripheral outer side of the first wall, the first wall gradually tilts outward radially in a direction from the door to the door mounting plate, the second wall gradually tilts inward radially in a direction from the door to the door mounting plate.

In some embodiments of the present disclosure, the door assembly of the air conditioner indoor unit further includes a guide ring disposed at an opening side of the guiding groove facing the door, and the inner peripheral wall of the guide ring gradually tilts inward radially in a direction towards the switch.

Optionally, the outer peripheral wall of the guiding part is parallel to the inner peripheral wall of the guide ring.

Optionally, the inner peripheral wall of the guide ring is provided with a positioning protrusion.

In some embodiments of the present disclosure, the door includes a baseplate and a cover plate, and the cover plate is disposed at a side of the baseplate away from the door mounting plate, and the cover plate is removable relative to the baseplate, wherein the guiding part is disposed at a side of the baseplate adjacent to the door mounting plate.

Optionally, a protrusion part protruding toward the cover plate is disposed at the central portion of the baseplate, and the side of the protrusion part away from the cover plate is provided with a mounting groove, and the guiding part is disposed in the mounting groove.

Further, the guiding part includes a bottom wall and a peripheral wall circumferentially disposed around the bottom wall, the bottom wall and a portion of the peripheral wall are received in the mounting groove, and the peripheral wall is movably disposed in the guiding groove.

Optionally, the baseplate and the guiding part are detachably connected.

The present disclosure also provides an air conditioner indoor unit having the door assembly according to the embodiments.

An air conditioner indoor unit according to the second embodiment of the present disclosure includes an outer box baseplate component, panel component, and the door assembly of the air conditioner indoor unit. One side of the outer box baseplate component is open, and the panel component is disposed at the open side of the outer box baseplate component, the panel component is provided with an air outlet, the door mounting plate is disposed at the side of the panel component facing the baseplate component, and the door can open and close the air outlet by moving, when the door opens the air outlet, the door is located on a side of the panel component away from the outer box baseplate component.

The air conditioner indoor unit according to the embodiments of the present disclosure, with the door assembly, the air outlet can be better closed, and at the same time, the door is relatively stable when moving between the open position and the closed position. The limiting effect is better, and the fit clearance between the door and the panel component is relatively uniform when the door is in the closed position, so that the air conditioner indoor unit is more beautiful.

Additional aspects and benefits of the present disclosure will be presented in the following sections, which will become apparent from the following descriptions or through the practice of the present disclosure.

BRIEF DESCRIPTION OF THE DRAWINGS

The above and/or additional aspects and advantages of the present disclosure will become apparent and easy to understand from the description of embodiments in combination with the attached drawings below, where.

REFERENCE NUMERALS

100: door assembly for an air conditioner indoor unit;
1: Door mounting plate; 11: frame; 12: mounting structure; 121: receiving groove; 1211: protruding slot; 1212 bottom wall;
122: guiding groove; 1221: first wall; 1222: second wall;
2: door; 21; baseplate; 211: protrusion part; 2111: mounting groove; 2112: snap protrusion; 22: cover plate;
3: guiding part; 31: bottom wall; 311: groove; 32: peripheral wall;
4: drive assembly; 41: expansion link;
6: guide ring; 61: positioning protrusion;
1000: air conditioner indoor unit;
200: outer box baseplate component;
300: panel component; 5: air outlet.

DETAILED DESCRIPTION

The embodiments of the present disclosure are described in detail below, and examples of the embodiments are shown in the attached drawings, where throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

In the description of the present disclosure, it should be understood that the orientation or position relations indicated with the terms "lateral", "length", "up", "down", "front", "back", "left", "right", "horizontal", "bottom", "inner", "outer", "radial", "circumferential" and the like are based on the orientation or position relationships shown in the attached drawings, are used only for the convenience of describing the present disclosure and simplifying the description, rather than indicating or implying that the device or element referred to must have a particular orientation, be constructed and operated in a particular orientation, so they shall not be construed as a restriction on the present disclosure. In addition, a feature defined as "first" or "second" may, explicitly or implicitly, include one or more such features. Unless otherwise stated, "multiple" means two or more in the description of the present disclosure.

In the description of the present disclosure, it should be noted that unless otherwise expressly specified and defined, the terms "installation", "linking" and "connection" shall be understood generally, for example, it may be fixed connection, detachable connection, or integral connection; or mechanical or electrical connections; or direct linking, indirect linking through an intermediate medium, or internal connection of two components. The specific meaning of the above terms in the present disclosure may be understood on a case by case basis by ordinary technical personnel in the field.

A door assembly 100 for an air conditioner indoor unit according to an embodiment of the present disclosure is described below with reference to FIGS. 1-9.

Figure 3:
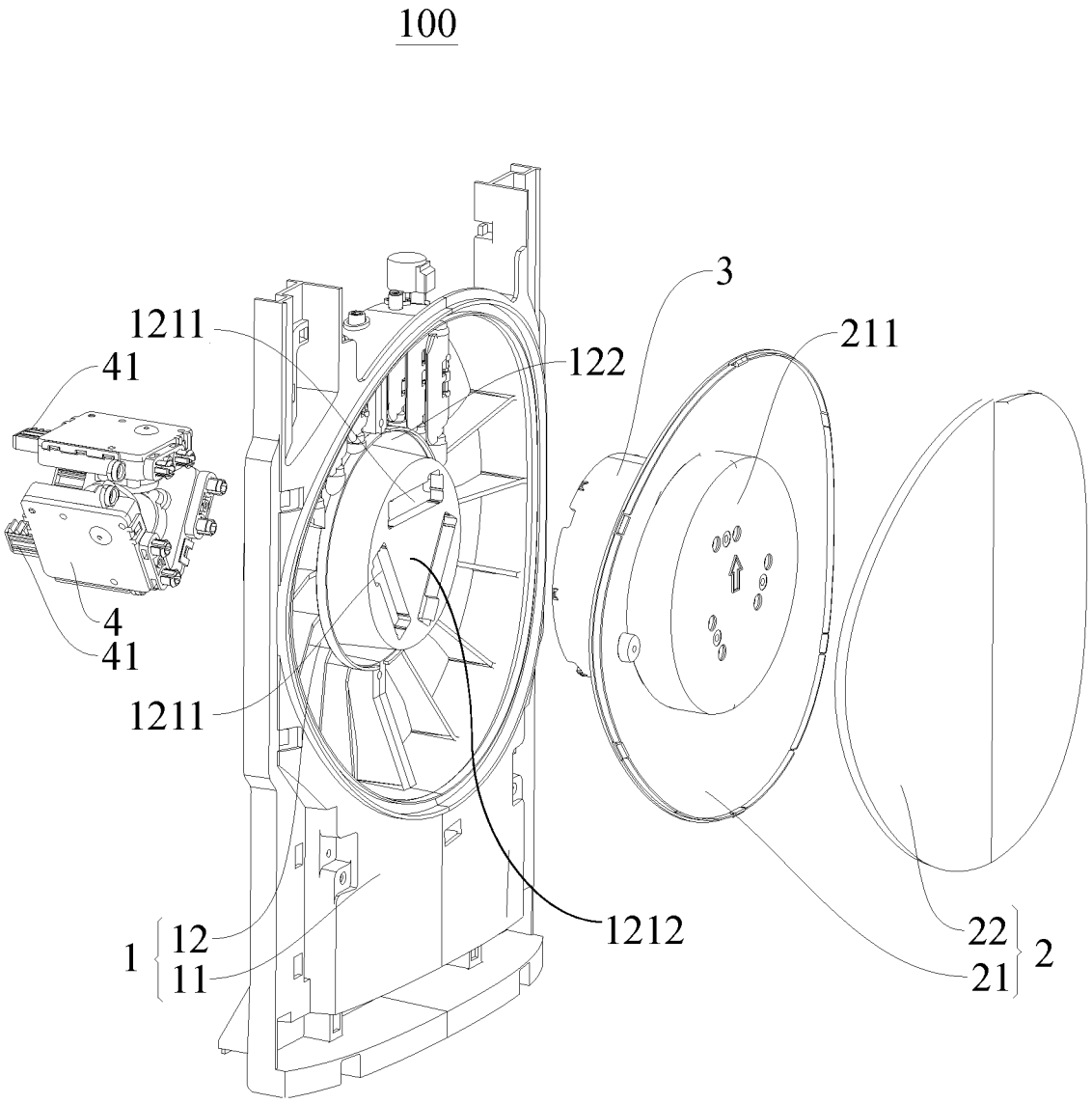
FIG. 3 is a structural explosion view of a door assembly of an air conditioner indoor unit according to an embodiment of the present disclosure.
Figure 4:
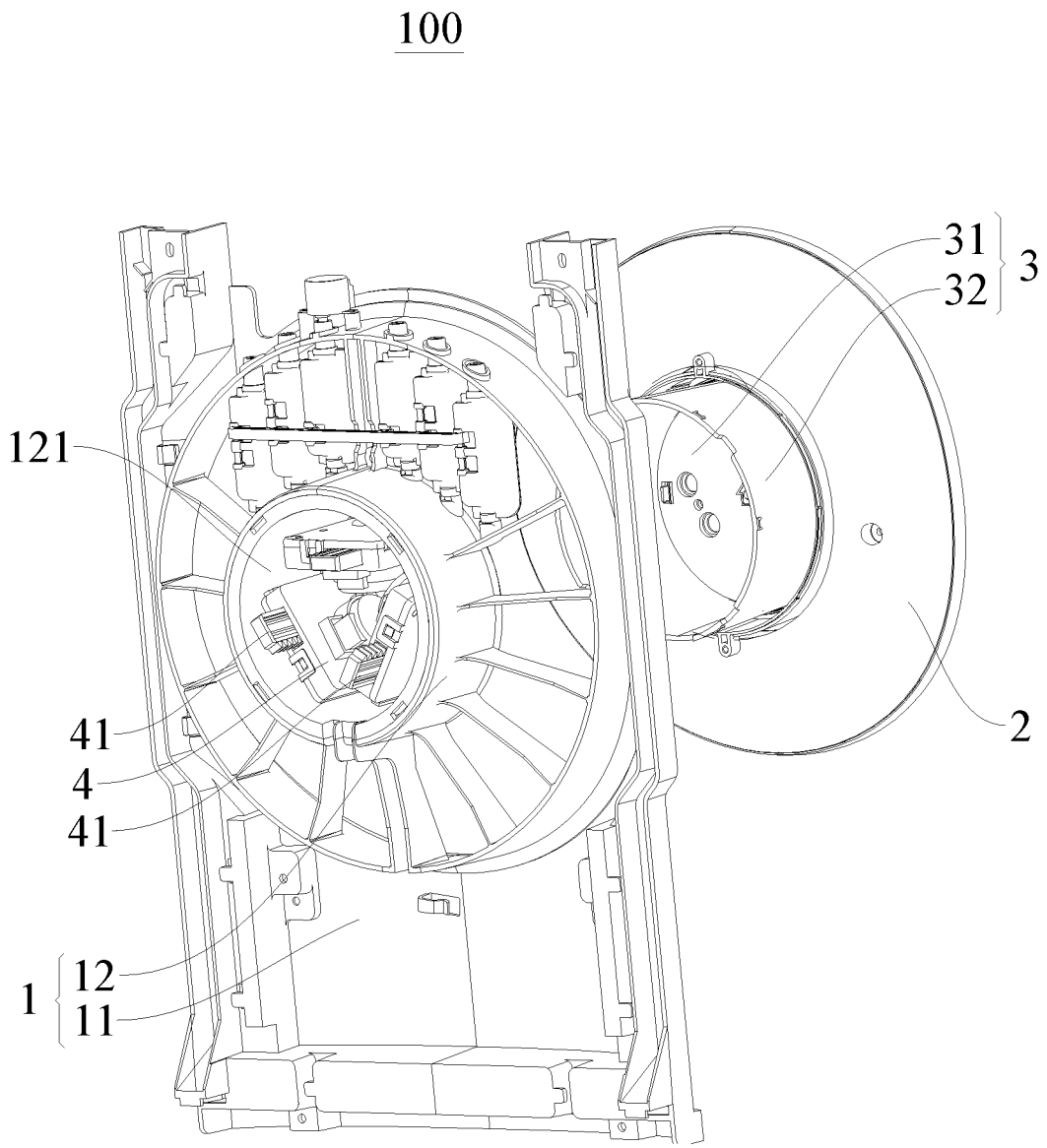
FIG. 4 is a schematic structural view showing the separation of the door and the guiding part and the door mounting plate in a door for the air conditioner indoor unit according to an embodiment of the present disclosure.
Figure 5:
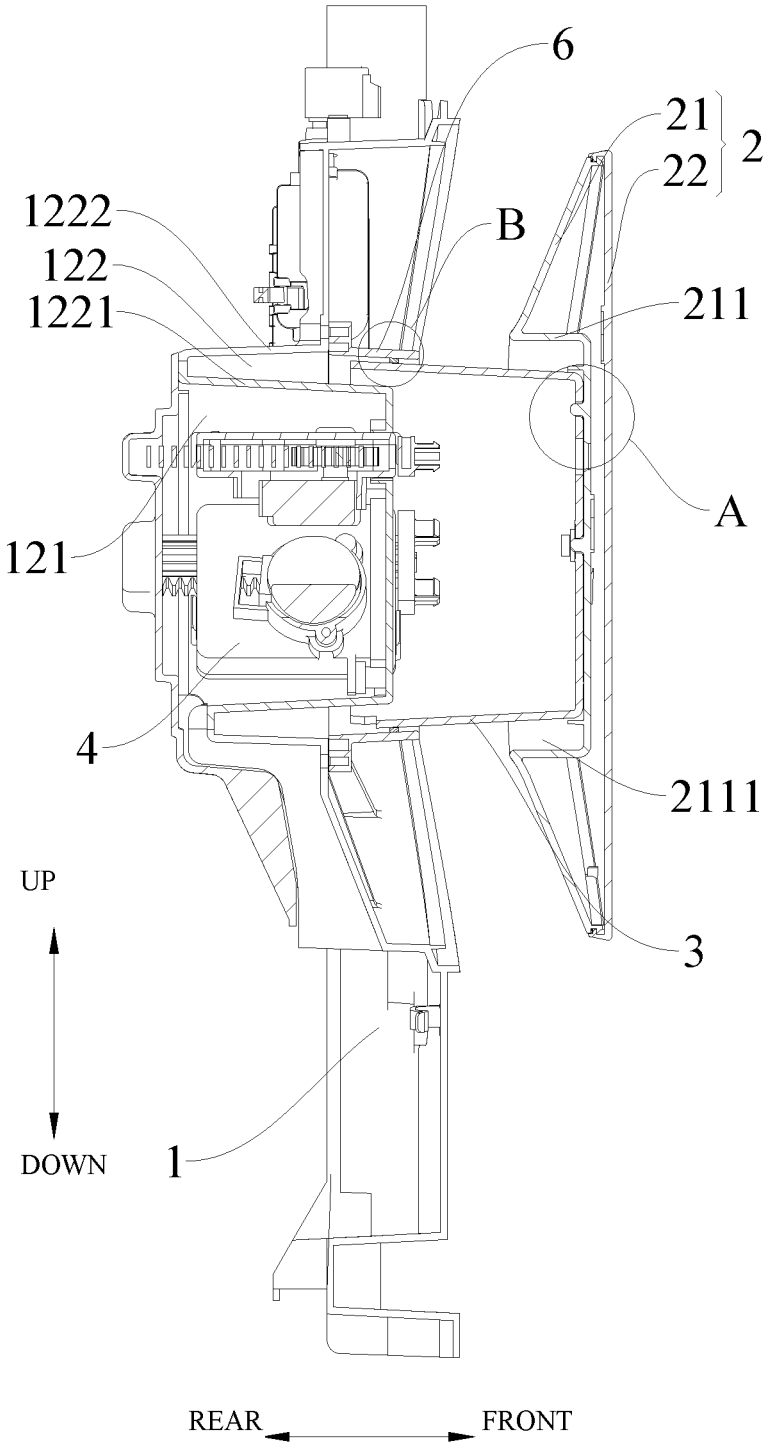
FIG. 5 is a cross-sectional view of the door in the door assembly for the air conditioner indoor unit according to an embodiment of the present disclosure in the open position.

As shown in FIGS. 3-5, the door assembly 100 for an air conditioner indoor unit according to an embodiment of the present disclosure includes a door mounting plate 1, a door 2, a guiding part 3 and a drive assembly 4. The door mounting plate 1 is provided with a receiving groove 121, and the door mounting plate 1 is further provided with a guiding groove 122, the door 2 is movable in a direction approaching and away from the door mounting plate 1, the guiding part 3 is connected to the door 2 and is located on the side of the door 2 facing the door mounting plate 1, and the guiding part 3 is movably disposed in the guiding groove 122, and the drive assembly 4 is used to drive the door 2 to move and disposed in the receiving groove 121.

That is, the door mounting plate 1 has a receiving groove 121 in which the drive assembly 4 can be mounted, and the drive assembly 4 can cooperate with the door 2 to drive the door 2, so that the door 2 moves towards the door mounting plate 1, or the door 2 moves in a direction away from the door mounting plate 1.

The side of the door 2 facing the door mounting plate 1 is provided with the guiding part 3, and the side of the door mounting plate 1 facing the door 2 is provided with the guiding groove 122, and the guiding part 3 can cooperate with the guiding groove 122, so that the guiding part 3 can slide along the guiding groove 122 during the movement of the door 2, and the stability of the door 2 is good.

Figure 6:
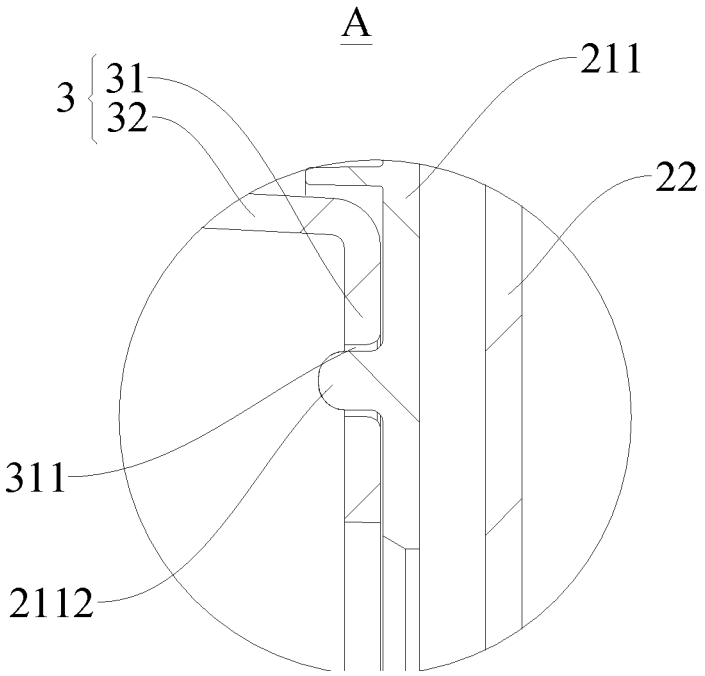
FIG. 6 is an enlarged view of Area A in FIG. 5.
Figure 7:
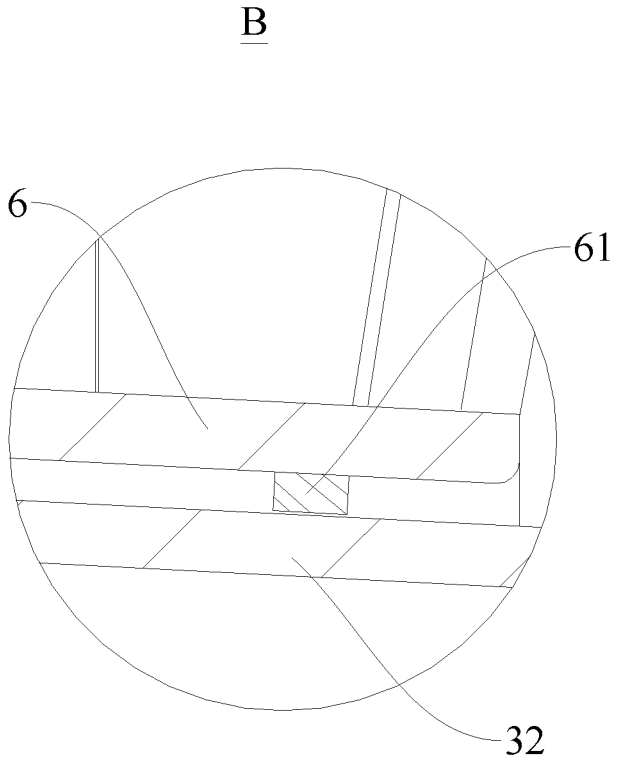
FIG. 7 is an enlarged view of Area B in FIG. 5.
Figure 8:
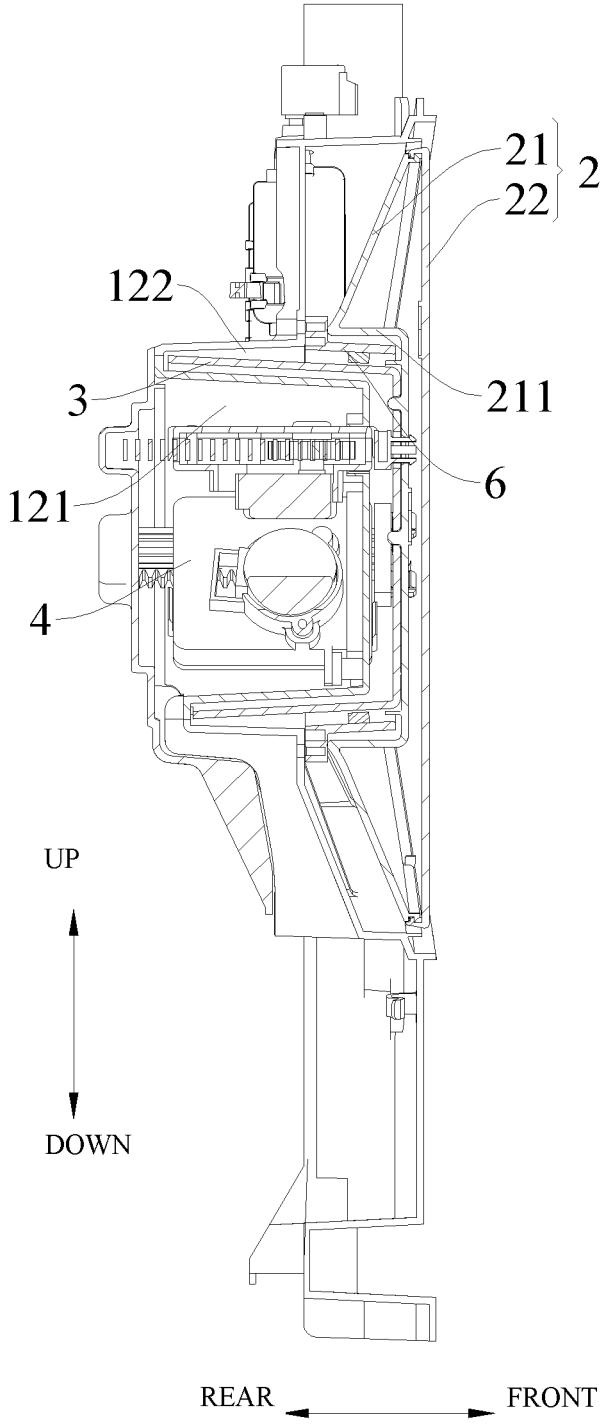
FIG. 8 is a cross-sectional view of the door in the door assembly for the air conditioner indoor unit according to an embodiment of the present disclosure in the closed position.
Figure 9:
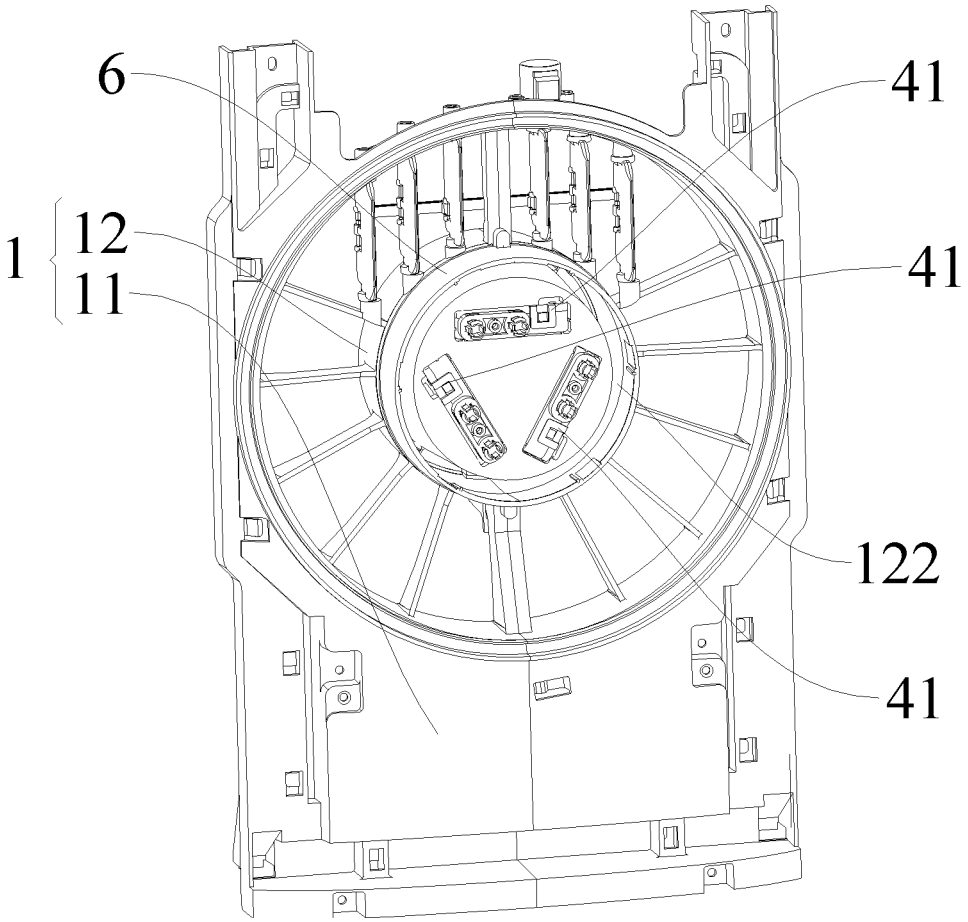
FIG. 9 is a schematic structural view of a door mounting plate in a door assembly for the air conditioner indoor unit according to an embodiment of the present disclosure.

For convenience of explanation, as shown in FIGS. 5 and 6, the direction of the door 2 facing the door mounting plate 1 is backward, and the direction of the door mounting plate 1 facing the door 2 is forward, so the drive assembly 4 can drive the door 2 to move forward or backward.

Thus, for the door assembly 100 according to the first embodiment of the present disclosure, the guiding part 3 can slide along the guiding groove 122 when the drive assembly 4 drives the door 2 to move forward or backward, and the door 2 can also slide along with the guiding part 3, so that the door 2 has a better stability when moving. In addition, while the guiding stricture 3 is sliding along the guiding groove 122, the guiding groove 122 can also limit the guiding part 3, thereby controlling the movement track of the door, making the movement trajectory of the door more precise.

Figure 1:
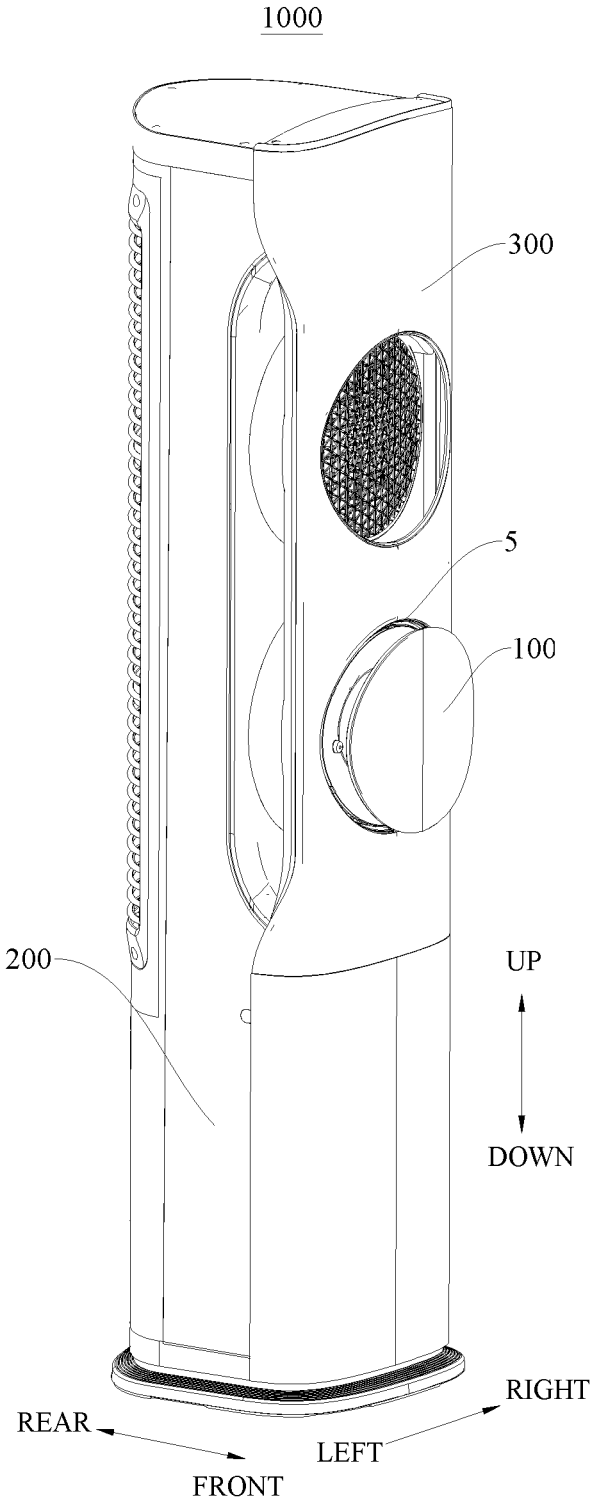
FIG. 1 is a perspective view of an air conditioner indoor unit according to an embodiment of the present disclosure.

In some embodiments of the present disclosure, as shown in FIGS. 3 and 4, the door mounting plate 1 includes: a frame 11 and a mounting part 12, the mounting part 12 is disposed at the frame 11 and located at the lateral middle position of the frame 11, where the lateral direction refers to the left-right direction as shown in FIG. 1, therefore, the mounting part 12 is provided in the middle of the frame 11 in the left-right direction. The receiving groove 121 and the guiding groove 122 are formed at the mounting part 12, which can reduce the number of components in the door assembly 100 for the air conditioner indoor unit, and is convenient for assembly. Meanwhile, as shown in FIG. 5, the receiving groove 121 and the guiding groove 122 can be arranged in a nested manner, which can save the internal space of the door assembly 100 for the air conditioner indoor unit, and is advantageous for the layout thereof.

In some embodiments of the present disclosure, the receiving groove 121 is formed at a side of the mounting part 12 far from the door 2, the drive assembly 4 is disposed in the receiving groove 121, and at least one part of the drive assembly 4 passes through the bottom wall 1212 of the receiving groove 121 and then is connected to the door 2. That is to say, the drive assembly 4 may be partially connected to the door 2 after passing through the bottom wall 1212 of the receiving groove 121, or may be connected to the door 2 after thoroughly passing through the bottom wall 1212 of the receiving groove 121.

Optionally, as shown in FIG. 3, the bottom wall 1212 of the receiving groove 121 is provided with a protruding slot 1211. The drive assembly 4 includes a motor, a gear and a rack 41. The rack 41 can pass through the protruding slot 1211 and connect with the door 2, and thereby drive the door 2 to move up and down in the front-rear direction. At this time, the driving assembly 4 is restricted between the mounting part 12 and the frame 11, which facilitates the holding of the drive assembly 4 by the receiving groove 121, and also avoid abrasion between the drive assembly 4 and any other part in the switch assembly 100 for the air conditioner indoor unit. Further, there can be multiple protruding slots 1211 and the racks 41, and multiple racks 41 drive the door 2 to move in the front-rear direction, which is relatively stable.

Optionally, as shown in FIGS. 3-8, the guiding groove 122 is formed at the side of the mounting part 12 facing the door 2. For example, as shown in FIG. 5, the guiding groove 122 extends substantially in the front-rear direction, which likely allows a considerable length of the guiding groove 122 in the front-rear direction of the mounting part 12, which facilitates the guiding groove 122 to guide the guiding part 3, and also allows the guiding groove 122 to have a better limiting effect on the guiding part 3. At the same time, the guiding groove 122 extending substantially in the horizontal direction also facilitates the cooperation of the guiding groove 122 and the guiding part 3.

In some embodiments of the present disclosure, as shown in FIGS. 5-9, the guiding groove 121 has a ring shape and is disposed around the outer side of the receiving groove 121. Thereby, the drive assembly 4 in the receiving groove 121 can protrude from the annular hole of the guiding groove 122 without affecting the cooperation of the guiding groove 122 with the guiding part 3. In addition, the annular guiding groove 122 can limit the guiding part 3 in the axial direction and the radial direction, so that the guiding groove 122 has better limiting effect on the guiding part 3, and the movement trajectory is more precise.

Further, as shown in FIGS. 5-8, the cross-sectional area of the guiding groove 122 gradually decreases in the direction from the door 2 to the door mounting plate 1, that is, the cross-sectional area of the guiding groove 122 reaches the maximum at the end close to the door 2, which results in easy engagement between the guiding part 3 and the guiding groove 122; the cross-sectional area of the guiding groove 122 reaches the minimum at the end near the door mounting plate 1, which results in closer engagement between the guiding part 3 and the guiding groove 122 when the guiding part 3 moves towards the door mounting plate 1 along the guiding groove 122, thus further enhancing the limiting effect of the guiding groove 122 on the guiding part 3, and facilitating control of the movement trajectory of the door 2. Here, the plane in which the cross section is located is a plane formed by straight lines extending in the up-down and the left-right direction as shown in FIG. 1.

Optionally, as shown in FIGS. 5-8, the guiding groove 122 is formed by an annular first wall 1221 and an annular second wall 1222 disposed around the receiving groove 121, and the second wall 1222 is sleeved around circumferential outer side of the first wall 1221. So, in some examples, when the guiding part 3 is engaged with the guiding groove 122, the guiding part 3 can slide along the outer wall surface of the first wall 1221, and in some other examples, the guiding part 3 can slide along the inner wall surface of the first wall 1222, and in some examples, the guiding part 3 slides between the inner wall surface of the second wall 1222 and the outer wall surface of the first wall 1221. The first wall 1221 is gradually inclined radially outward in a direction from the door 2 to the door mounting plate 1, and the second wall 1222 is gradually inclined radially inwards in a direction from the door 2 to the door mounting plate 1. So, the guiding groove 122 formed by the first wall 1221 and the second wall 1222 extends in the front-rear direction in a cross-sectional view as shown in FIG. 5, with the opening facing the horn of the guiding part 3, which leads to easier engagement between the guiding part 3 and the guiding groove 122, and reduces the risk of collide with the first wall 1221 or the second wall 1222 of the guiding groove 122.

In some embodiments of the present disclosure, as shown in FIGS. 3-5, the door 2 includes a baseplate 21 and a cover plate 22, and the cover plate 22 is disposed at a side of the baseplate 21 away from the door mounting plate 1, and the cover plate 22 is removable relative to the baseplate 21, wherein the guiding part 3 is disposed at a side of the baseplate 21 adjacent to the door mounting plate 1. That is, after the cover 22 is fitted to the baseplate 21, the cover 22 and the baseplate 21 can be separated. For example, the baseplate 21 and the cover plate 22 can be separated, the guiding part 3 can be mounted at the baseplate 21, and then the cover plate 22 can be mounted at the baseplate 21 to make the door 2 more beautiful, thus improving the mounting efficiency of the guiding part 3 and the door 2 without affecting the appearance of the door 2.

Further, as shown in FIGS. 3-5, a protrusion part 211 protruding toward the cover plate 22 is disposed at the central portion of the baseplate 21, and the side of the protrusion part 211 away from the cover plate 22 is provided with a mounting groove 2111, and the guiding part 3 is disposed in the mounting groove 2111. That is to say, the mounting groove 2111 is formed in the middle of the baseplate 21 and can extend toward the cover plate 22, the opening of the mounting groove 2111 faces the door mounting plate 1, and the guiding part 3 is mounted at the baseplate 21 through the mounting groove 2111.

Further, as shown in FIGS. 3-5, the guiding part 3 includes a bottom wall 31 and a peripheral wall 32 circumferentially disposed around the bottom wall 31, the bottom wall 31 and a portion of the peripheral wall 32 are received in the mounting groove 2111, and the peripheral wall 32 is movably disposed in the guiding groove 122. That is, the guiding part 3 is formed in a cylindrical shape with the opening facing the door mounting plate 1, and the bottom wall 31 of the guiding part 3 can protrude into the mounting groove 2111 and be mounted at the bottom wall of the mounting groove 2111, so that the extension length of the peripheral wall 32 of the guiding part 3 in the front-rear direction is increased, thus facilitating the engagement and the limitation between the guiding part 3 and the guiding groove 122, so that the movement trajectory of the door 2 can be better controlled.

In some examples of the disclosure, the baseplate 21 and the guiding part 3 are detachably connected. Thereby, the baseplate 21 and the guiding part 3 can be easily mounted and dismounted. For example, as shown in FIG. 5 and FIG. 6, a groove 311 is formed in the bottom wall 31 of the guiding part 3, and a snap protrusion 2112 is formed at a side of the protrusion part 211 facing the door mounting plate 1, enabling efficient mounting and dismounting between the bottom 21 and the guiding part 3 through the engagement between snap protrusion 2112 and groove 311.

In some embodiments of the present disclosure, the door assembly of the air conditioner indoor unit further includes a guide ring 6 disposed at an opening side of the guiding groove 122 facing the door 2, and the inner peripheral wall of the guide ring 6 gradually tilts inward radially in a direction towards the switch. Here, the inner peripheral wall refers to the inner wall surface of the guide ring 6 facing the guiding part 3 when the guiding part 3 is engaged with the guiding groove 122. That is, the guide ring 6 is disposed between the guiding groove 122 and the door 2, and as shown in FIG. 5, while the door 2 is moving forward and backward, the guiding part 3 can be engaged with the guide ring 6 so as to slide towards the guiding groove 122 along the inner wall surface of the guide ring 6, so that the guiding part 3 can be more easily fitted to the guiding groove 122. The inner wall surface of the guide ring 6 extends obliquely downward while the guide ring 6 is extending forward and backward, so that after the guiding part 3 enters the guiding groove 122 along the guide ring 6, the guide ring 6 can cooperate with the guiding groove 122 to jointly limit the guiding part 3, thereby better control the movement of the door 2.

Optionally, as shown in FIGS. 5-9, the guide ring 6 may extend from rear to the front, and in the front-rear direction, the length of the second wall 1222 plus guide ring 6 is greater than the length of the first wall 1221, therefore, the guide ring 6 can increase the guiding length of the guiding part 3 in the front-rear direction, thus facilitating the movement of the door 2 between the open position and the closed position. Further, when the door 2 is moving between the open position and the closed position, the guiding part 3 can always cooperate with the guide ring 6 to avoid the problem that the guiding part 3 may offset after sliding out of the guiding groove 122 during the moving process, leading to difficult future engagement with the guiding groove 122.

Optionally, the outer peripheral wall of the guiding part 3 is parallel to the inner peripheral wall of the guide ring 6. It should be noted that the outer peripheral wall of the guiding part 3 refers to the outer wall surface of the guide ring 6 facing the guiding part 3 when the guiding part 3 is engaged with the guiding groove 122. So, the outer wall surface of the guiding part 3 is parallel to the inner wall surface of the guide ring 6, thus enabling the guiding part 3 to better slide along the inner wall surface of the guide ring 6.

Optionally, the inner peripheral wall of the guide ring 6 is provided with a positioning protrusion 61, and the positioning protrusion 61 can reduce the fit clearance between the guide ring 6 and the guiding part 3, and further limit the guiding part 3, thus improving the limiting effect of the guide ring 6 on the guiding part 3, so as to further control the movement of the door 2 between the open position and the moving position, and the guiding part 3 can be prevented from shaking.

The present disclosure also provides a door assembly 100 according to the above embodiments and an air conditioner indoor unit 1000 having the door assembly.

Figure 2:
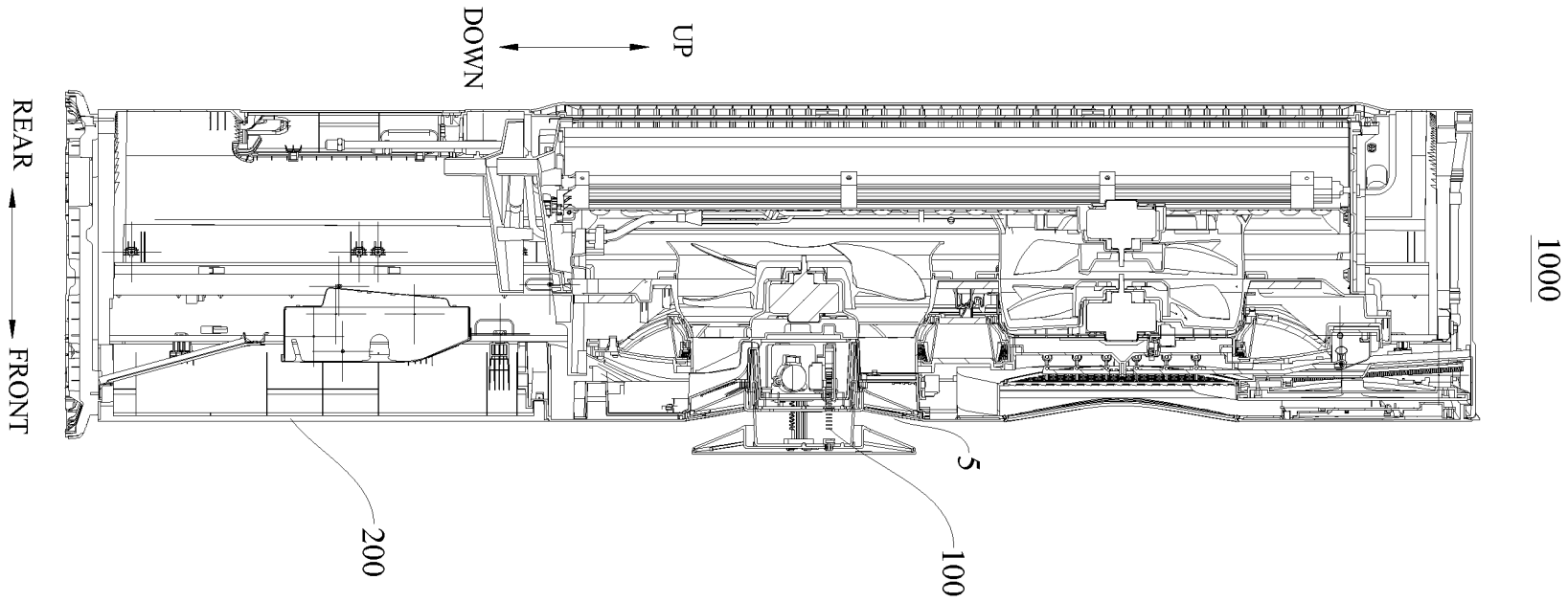
FIG. 2 is a cross-sectional view of an air conditioner indoor unit according to an embodiment of the present disclosure.

As shown in FIGS. 1 and 2, an air conditioner indoor unit 1000 according to the second embodiment of the present disclosure includes an outer box baseplate component 200, panel component 300, and the door assembly 100 of the air conditioner indoor unit. One side of the outer box baseplate component 200 is open, the panel component 300 is disposed at the open side of the outer box baseplate component 200, the panel component 300 is provided with an air outlet 5, whereby air generated by heat exchange of the air conditioner can be discharged through the air outlet 5.

The door mounting plate 1 is disposed at the side of the panel component 300 facing the outer box baseplate component 200, and the door 2 can open and close the air outlet 5 by moving, when the door 2 opens the air outlet 5, the door 2 is located on a side of the panel component 300 away from the outer box baseplate component 200. That is, the door 2 has an open position and a closed position in the process of moving back and forth, and the door 2 can close the air outlet 5 when the door 2 is in the closed position, preventing particulate pollutants in the air from entering the interior of the air conditioner indoor unit 1000 which would affect the quality of air blown by the air conditioner. The door 2 can move forward when the it moves from the closed position toward the open position, so that it can move to the front side of the panel member 300.

Therefore, in the air conditioner indoor unit 1000 according to the embodiments of the present disclosure, with the help of the door assembly 100, the air outlet 5 can be better closed, and at the same time, the door 2 is relatively stable when moving between the open position and the closed position. The limiting effect is better, and the fit clearance between the door 2 and the panel component 300 is relatively uniform when the door 2 is in the closed position, so that the air conditioner indoor unit 1000 is more beautiful.

Other configurations and operations of the air conditioner indoor unit 1000 according to embodiments of the present disclosure are known to those of ordinary skill in the art and will not be described in detail herein.

In the description of the present disclosure, the terms "some embodiments" "optionally" "further" or "some examples" etc. means that the specific feature, structure, material or characteristic of that embodiment or example described are included in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples.

Although the embodiments of the present disclosure have been presented and described, the ordinary technical personnel in the field can understand that multiple changes, modifications, substitutions and variations of such embodiments can be made without deviating from the principles and purposes of the present disclosure, and that the scope of the invention is defined by the claims and their equivalents.

What is claimed is:

1. A door assembly for an air conditioner indoor unit, comprising:

a door mounting plate including a receiving groove and a guiding groove;

a door configured to be movable in a direction approaching and away from the door mounting plate;

a guiding part connected with the door, located at a side of the door facing the door mounting plate, and movably disposed in the guiding groove, the guiding part including:

a bottom wall; and a peripheral wall circumferentially disposed around the bottom wall, the peripheral wall extending from the bottom wall in a direction away from the door; and a drive assembly configured to drive the door to move, and disposed in the receiving groove, the drive assembly being connected to the bottom wall of the guiding part.

2. The door assembly according to claim 1, wherein:

the door mounting plate comprises:

a frame; and a mounting part provided at the frame and located in a lateral middle portion of the frame; and the receiving groove and the guiding groove are formed in the mounting part.

3. The door assembly according to claim 2, wherein:

the receiving groove is formed in a side of the mounting part away from the door; and at least a part of the drive assembly passes through a bottom wall of the receiving groove to be connected to the door.

4. The door assembly according to claim 2, wherein the guiding groove is formed in a side of the mounting part facing the door.

5. The door assembly according to claim 1, wherein the guiding groove has a ring shape and is around an outer side of the receiving groove.

6. The door assembly according to claim 5, wherein a cross-sectional area of the guiding groove gradually decreases in a direction from the door to the door mounting plate.

7. The door assembly according to claim 5, wherein:

the guiding groove includes a first wall and a second wall each having a ring shape and being around the receiving groove;

the second wall is fitted over a peripheral outer side of the first wall;

the first wall is radially inclined outwards gradually in a direction from the door to the door mounting plate; and the second wall is radially inclined inwards gradually in the direction from the door to the door mounting plate.

8. The door assembly according to claim 1, further comprising:

a guide ring provided at an opening side of the guiding groove facing the door, an inner peripheral wall of the guide ring being gradually inclined radially inwards in a direction towards the door.

9. The door assembly according to claim 8, wherein an outer peripheral wall of the guide ring is parallel to the inner peripheral wall of the guide ring.

10. The door assembly according to claim 8, wherein the inner peripheral wall of the guide ring includes a positioning protrusion.

11. The door assembly according to claim 1, wherein:

the door comprises:

a baseplate; and a cover plate provided on a side of the baseplate facing away from the door mounting plate, the cover plate being removable from the baseplate; and the guiding part is disposed at a side of the baseplate facing the door mounting plate.

12. The door assembly according to claim 11, wherein:

the baseplate includes a protrusion part at a middle portion of the baseplate and protruding towards the cover plate, a side of the protrusion part facing away from the cover plate including a mounting groove; and the guiding part is disposed at the mounting groove.

13. The door assembly according to claim 12, wherein the bottom wall of the guiding part and a part of the peripheral wall of the guiding part are received in the mounting groove, and the peripheral wall is movably disposed in the guiding groove.

14. The door assembly according to claim 11, wherein the baseplate and the guiding part are detachably connected to each other.

15. The door assembly according to claim 1, wherein the receiving groove and the guiding groove open towards opposite directions.

16. An air conditioner indoor unit comprising:

an outer box baseplate component having an open side;

a panel component disposed at the open side of the outer box baseplate component, and including an air outlet;

a door assembly including:

a door mounting plate disposed at a side of the panel component facing the outer box baseplate component, the door mounting plate including a receiving groove and a guiding groove;

a door configured to move approaching the door mounting plate to cover the air outlet or away from the door mounting plate to expose the air outlet;

a guiding part connected with the door, located at a side of the door facing the door mounting plate, and movably disposed in the guiding groove, the guiding part including:

a bottom wall; and a peripheral wall circumferentially disposed around the bottom wall, the peripheral wall extending from the bottom wall in a direction away from the door; and a drive assembly configured to drive the door to move, and disposed in the receiving groove, the drive assembly being connected to the bottom wall of the guiding part.

17. The air conditioner indoor unit of claim 16, wherein the door mounting plate comprises:

a frame; and a mounting part provided at the frame and located in a lateral middle portion of the frame; and the receiving groove and the guiding groove are formed in the mounting part.

18. The air conditioner indoor unit of claim 16, wherein the guiding groove has ring shape and is around an outer side of the receiving groove.

19. The door assembly according to claim 1, wherein:

the receiving groove includes an opening and a bottom wall at opposite ends of the receiving groove;

the door is closer to the bottom wall of the receiving groove than to the opening of the receiving groove; and at least a part of the drive assembly passes through the bottom wall of the receiving groove to be connected to the bottom wall of the guiding part.

20. The door assembly according to claim 1, wherein the drive assembly includes a motor, a gear, and a rack, and the rack being connected to the door.

* * * * *